US006359391B1

(12) United States Patent
Li

(10) Patent No.: US 6,359,391 B1
(45) Date of Patent: Mar. 19, 2002

(54) SYSTEM AND METHOD FOR OVERVOLTAGE PROTECTION DURING PULSE WIDTH MODULATION DIMMING OF AN LCD BACKLIGHT INVERTER

(75) Inventor: Yushan Li, Ossining, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/657,925

(22) Filed: Sep. 8, 2000

(51) Int. Cl.[7] ..... G05F 1/00

(52) U.S. Cl. ..... 315/291; 315/307; 315/219; 315/DIG. 4; 315/119; 361/91.1

(58) Field of Search ..... 315/291, 307, 315/308, 224, 225, 215, 219, 209 R, DIG. 4, DIG. 5, DIG. 7, 119; 361/90, 91.1–91.8

(56) References Cited

U.S. PATENT DOCUMENTS

| | | | | | |
|---|---|---|---|---|---|
| 4,513,226 | A | | 4/1985 | Josephson | 315/219 |
| 4,523,128 | A | | 6/1985 | Stamm et al. | 315/291 |
| 4,525,649 | A | | 6/1985 | Knoll et al. | 315/96 |
| 4,590,533 | A | * | 5/1986 | Murata | 361/91.3 |
| 5,117,161 | A | | 5/1992 | Avrahami | 315/226 |
| 5,371,439 | A | * | 12/1994 | Griffin | 315/209 R |
| 5,391,966 | A | * | 2/1995 | Garrison | 315/308 |
| 5,424,611 | A | | 6/1995 | Moriarty, Jr. | 315/94 |
| 5,574,336 | A | | 11/1996 | Konopka et al. | 315/225 |
| 5,680,017 | A | | 10/1997 | Veldman et al. | 315/308 |
| 5,910,709 | A | * | 6/1999 | Stevanovic et al. | 315/225 |
| 5,930,121 | A | | 7/1999 | Henry | 363/16 |
| 6,011,360 | A | | 1/2000 | Gradzki et al. | 315/244 |
| 6,084,361 | A | | 4/2000 | Wacyk | 315/291 |
| 6,114,814 | A | * | 9/2000 | Shannon et al. | 315/219 |

* cited by examiner

*Primary Examiner*—Don Wong
*Assistant Examiner*—Ephrem Alemu

(57) ABSTRACT

A system and method for providing overvoltage protection during a pulse width modulation (PWM) dimming of a liquid crystal display (LCD) backlight inverter are provided. The disclosed system achieves overvoltage protection by providing two low voltages (or current) signals: an output voltage sensing signal and a protection trigger threshold signal. The output voltage sensing signal represents the ballast output voltage. The output voltage sensing and protection trigger threshold voltage signals are inputted into a comparator and overvoltage protection is activated if the output voltage sensing signal is higher than the protection trigger threshold voltage signal during a predetermined time interval.

34 Claims, 6 Drawing Sheets

SYSTEM AND METHOD FOR OVERVOLTAGE PROTECTION DURING PULSE WIDTH MODULATION DIMMING OF AN LCD BACKLIGHT INVERTER

BACKGROUND OF THE INVENTION

1. Technical Field

The present disclosure relates generally to backlight inverter circuitry for controlling a load. More specifically, the present disclosure relates to a system for providing overvoltage protection during a pulse width modulation (PWM) dimming of a liquid crystal display (LCD) backlight inverter.

2. Background of the Related Art

Overvoltage protection, which may include open circuit protection, is generally required for a backlight inverter circuit controlling a load, such as lamps, to provide safe and effective operation. When one or more lamps are not connected to the outputs of a ballast of the LCD backlight inverter, there is a huge voltage, i.e., an overvoltage condition occurs, across the ballast outputs, if some kind of protection method or system is not implemented. The overvoltage condition results in having a higher output voltage at the outputs of the ballast than a nominal output voltage when the lamps are connected to the outputs of the ballast. During the overvoltage condition, one can be injured if contact is made with the ballast outputs. Further, the overvoltage condition can damage the components of the ballast, and/or cause the ballast to run into an unexpected state, and eventually cause the ballast to be damaged.

Overvoltage protection in lamp driving circuits is described in U.S. Pat. Nos. 5,680,017, 6,011,360 and 6,084,361, the contents of which are hereby incorporated herein by reference.

In the present state of the art, as shown by the prior art backlight inverter of FIG. 1, when an overvoltage condition is detected, i.e., when the output voltage (which is proportional to an input current to controller U2) of the ballast circuit to the lamps is greater than a threshold voltage as compared by a comparator within the controller U2, a one shot timer is activated by an output of the comparator to time a one shot time interval.

The internal components of the controller U2 are described in detail in U.S. Pat. No. 5,680,017. Accordingly, the comparator used to detect an overvoltage condition may include comparator 421 which can detect a minimum overvoltage condition (OV'), comparator 424 which can detect a maximum overvoltage condition (OVMAX), or comparator 427 which can detect a "panic" overvoltage condition (OVPANIC). The input current is fed to pin VL of the controller U2.

With continued reference to U.S. Pat. No. 5,680,017 and additionally to U.S. Pat. No. 6,011,360, the one shot timer may include an external capacitor, i.e., outside controller U2, which is connected to the third pin designated by CP, and an external resistor which is connected to the 12th pin designated by Rref. If these components and circuitry are used with the controller U2 of the backlight inverter of FIG. 1, for example, and show that the overvoltage condition exists at the end of the one shot time, the backlight inverter circuit of FIG. 1 activates overvoltage protection. When overvoltage protection is triggered during full light output, the circuit is placed into a standby mode, and the output to lamps J1, J2 drops to zero.

As a side note, when short circuit protection is triggered by the backlight inverter of FIG. 1, a power stage module PSM is shut down by cutting off the supply voltage chip_Vdd to the controller U2, and accordingly, the output of control signals S1 and S2 to the power stage module PSM and PWM dimming logic circuitry U3, respectively. The oscillation of signal S1 is controlled by at least a LampOn signal received by the controller U2 from the PWM dimming logic circuitry U3. The signals S3 and S1 drive a low and a high side, respectively, of a power switch within the power stage module PSM.

Signal S2 causes the PWM dimming logic circuitry U3 to generate and transmit signal S3 to the power stage module PSM to operate the power stage module PSM. Once the controller U2 stops operating, signals S1 and S3 stop being generated. Then, the output voltage to lamps J1, J2 drops to zero.

The one shot timer is necessary to avoid shut down due to a fault trigger, where there could be a spike or a large transient output voltage for a very short time, even when the lamps are connected to the ballast outputs. In the case of a fault trigger, the overvoltage protection is not activated at the end of the one shot timer, because it is very unlikely a fault condition will occur at the beginning and end of the one shot timer, if the lamps are connected to the ballast outputs.

A disadvantage of this conventional overvoltage protection scheme arises when pulse width modulation (PWM) is used to dim an LCD backlight inverter as shown by FIG. 1, i.e., the circuitry used to control the load or the lamps. Dimming is achieved by turning on and off the lamps with a fixed frequency, and the dimming level, i.e., the amount of dimming, is determined according to the duty cycle of the PWM signal generated by the PWM signal generator GEN and fed to the PWM dimming logic circuitry U3. If the fixed frequency is approximately 170 Hz, one is not able to sense the lamp discontinuously turning on and off (i.e., flickering) and dimming is perceived with the average light output.

When the one shot timer is used for overvoltage protection, the duration of the one shot timer, e.g., 10 msec to one second, is typically much longer than the period of the PWM signal, e.g., approximately 5–6 msec. Since the lamps are discontinuously on and off due to the fixed frequency during PWM dimming of the LCD backlight inverter, even when the lamps are removed or disconnected from the ballast outputs B1, B2, it is impossible to reliably detect a fault condition at the end of the one shot timer, due to a different dimming level, operating frequency, etc. This problem is further described below with reference to FIGS. 2A–2C.

FIG. 2A is block diagram of a prior art overvoltage protection system designated generally by reference numeral 10. In this system, output sensing "OutputSensing") and threshold "Threshold") voltages are inputted into a comparator 12 within a controller (not shown), which may be similar to controller U2. The output sensing voltage corresponds to the ballast voltage output level. If the output sensing voltage is greater than the threshold voltage, an activation signal is transmitted to a one shot timer 14 and a logic circuit 16 within the controller. The activation signal activates the one shot timer 14 and the one shot timer 14 begins to time a predetermined one shot time interval. At the end of the predetermined one shot time interval, if the output sensing voltage is still greater than the threshold voltage, the controller stops oscillating and transmits signals SIG1, SIG2 to turn off at least one power switch within a power stage module (not shown), which may be similar to the power stage module PSM of FIG. 1.

FIG. 2B illustrates a timing diagram during activation of the one shot timer 14 of FIG. 2A The diagram shows the PWM signal and the corresponding output sensing voltage which is assumed to be higher than the threshold voltage. A high stop timer signal (signaling the beginning of the one shot timer interval) "StopTimer") is generated at time A by the one shot timer 14. When the output sensing voltage is high, i.e., at points A and C during a high PWM signal, the lamp is intended to turn on, and when the output sensing voltage is low, i.e., at points B and D during a low PWM signal, the lamp is intended to turn off. FIG. 2C illustrates a timing diagram depicting the time when the one shot timer 14 is deactivated, i.e., at the end of the predetermined one shot time interval.

A problem thus can arise at the end of the predetermined one shot time interval as exemplified in FIGS. 2B and 2C. As it can be seen from FIG. 2C, when the one shot timer 14 is off, i.e., at the end of the predetermined one shot time interval, the output voltage across the ballast outputs of the lamp is low, e.g., when the one shot time interval expires within time interval B of FIG. 2C, and the lamps are turned off due to the PWM cycling.

Accordingly, at the start of time interval C, the logic circuitry 16 will detect a low output of comparator 12 and the voltage across the ballast outputs, such as ballast outputs B1, B2 shown by FIG. 1, is kept high. However, the output voltage across the ballast outputs B1, B2 exceeds the threshold voltage. Regardless, since a low output of the comparator 12 is detected, overvoltage is not detected and hence, overvoltage protection is not triggered. This causes an overvoltage condition across the ballast outputs which cannot be reliably detected and protected.

Accordingly, a need exists for a system and method for providing overvoltage protection during pulse width modulation (PWM) dimming of a liquid crystal display (LCD) backlight inverter which overcomes the problems associated with the prior art.

SUMMARY OF THE INVENTION

In accordance with the present disclosure, a system and method for providing overvoltage protection during a pulse width modulation (PWM) dimming of a liquid crystal display (LCD) backlight inverter are provided which obviate the problems associated with the prior art.

The disclosed system and method achieves overvoltage protection by providing two low voltages (or equivalent current) signals: an output voltage sensing signal and a protection trigger threshold voltage signal. The output voltage sensing signal represents the ballast output voltage that may be obtained from an output transformer sensing winding or a capacitor divider across the ballast outputs as known in the art. The protection trigger threshold voltage signal represents a voltage level at a predetermined amount above the nominal loaded lamp voltage and below the unloaded overvoltage. The output voltage sensing signal is preferably scaled by a ratio factor to represent the output voltage and the protection trigger threshold voltage is scaled by the same ratio factor.

The output voltage sensing and protection trigger threshold voltage signals are inputted into a comparator and overvoltage protection is activated if and only if the output voltage sensing signal is higher than the protection trigger threshold voltage signal during a predetermined time interval. To minimize or ensure against erroneous overvoltage detections, the protection trigger threshold voltage signal is typically slightly higher, e.g., approximately 10% higher, than the worst case reflected ballast output voltage under all possible conditions.

In a first embodiment according to the present disclosure, when overvoltage protection during PWM dimming is reliably detected, the PWM signal is blocked (or masked) from reaching a power stage module which drives one or more lamps connected to the LCD backlight inverter. The PWM signal is blocked for a predetermined stop time interval, e.g., for approximately 10 msec to one second, as timed by a one shot timer, once an overvoltage condition is detected. If the overvoltage condition still exists at the end of the predetermined stop time interval, a latch is set and the entire system is shut down by interrupting the supply voltage to a controller.

It is contemplated that the overvoltage protection system of the present disclosure is designed to share the latch and associated circuitry of a short circuit protection system (or overcurrent protection system) to reduce the number of system components. By sharing components between the two protection systems, the total cost of the overvoltage protection system disclosed herein is reduced.

In a second embodiment according to the present disclosure, overvoltage protection during PWM dimming of the LCD backlight inverter is reliably detected, but the PWM signal which causes PWM dimming is not blocked or masked from the power stage module. In this case, the system ensures that the output voltage sensing signal accurately represents the overvoltage output voltage across the ballast outputs, even though during PWM dimming the output voltage is synchronized with the PWM signal. This is accomplished by using a sample and hold circuit where the overvoltage output voltage is detected during the lamp on period and the output voltage sensing signal which represents the overvoltage output voltage is held without discharging during the lamp off period. This prevents the output voltage sensing signal from discharging. The output voltage sensing signal is then provided to a similar circuit configuration as the first embodiment.

It is contemplated that the overvoltage protection system shares the latch and associated circuitry of the short circuit protection system to reduce the number of components and the total cost.

A variation of the second embodiment provides that the sample and hold scheme is not used for the output sensing voltage signal, but for the one shot timer. In this case, a series switch, either a BJT or MOS transistor, is connected to a one shot series capacitor. The switch is controlled either from its base or gate by a LampOn signal.

By using the series switch, the one shot time of the one shot timer is accumulated during the on period of the PWM signal and the series capacitor is not discharged during the off period of the PWM signal. Once the one shot timer reaches the predetermined one shot time, if there is an overvoltage condition, the latch is set and the supply voltage to the controller is interrupted, and hence overvoltage protection is provided.

DETAILED DESCRIPTION OF PREFERRED EMBODIMENTS

Preferred embodiments of the presently disclosed overvoltage protection system and method of the present disclosure will now be described in detail with reference to FIGS. 3–6. While the embodiments disclosed herein are designed for a liquid crystal display (LCD) backlight inverter for controlling at least one lamp (the load), the presently disclosed embodiments of the overvoltage protection system can be used in any application requiring overvoltage protection for operating a load.

Figure 1:
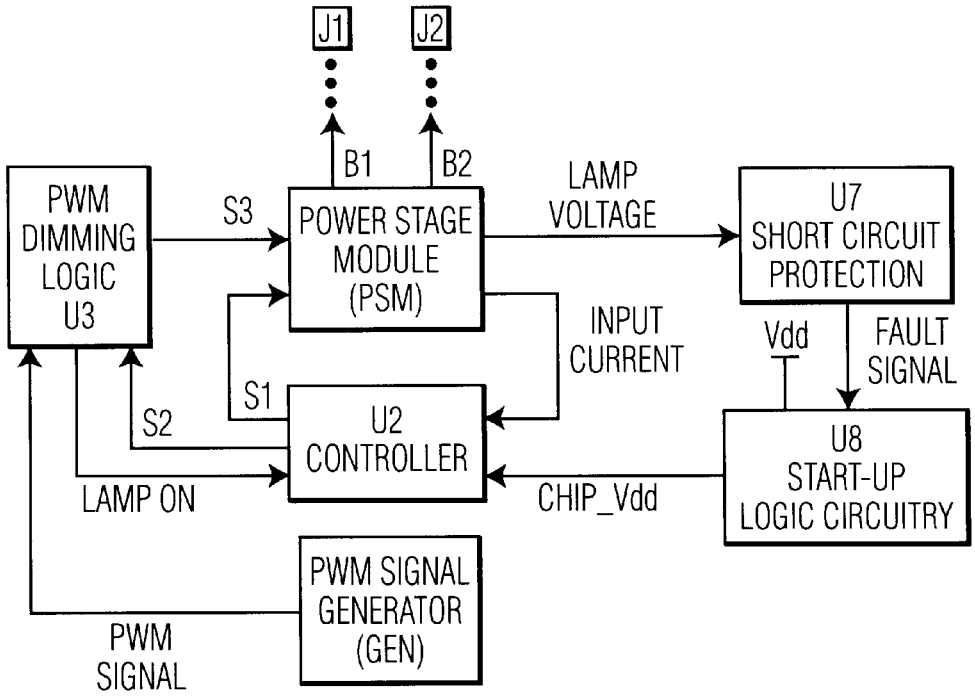
FIG. 1 (PRIOR ART)
FIG. 1 is a block diagram of a prior art LCD backlight inverter.
Figure 2A:
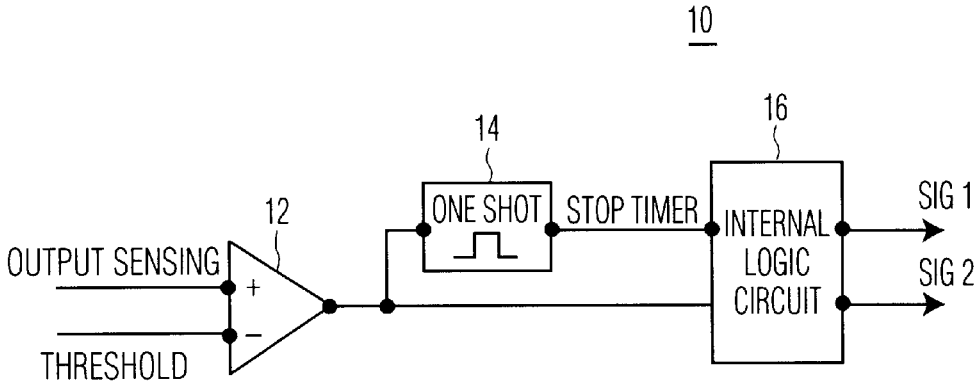
FIG. 2A (PRIOR ART)
FIG. 2A is a block diagram illustrating a prior art overvoltage protection system.
Figure 2B:
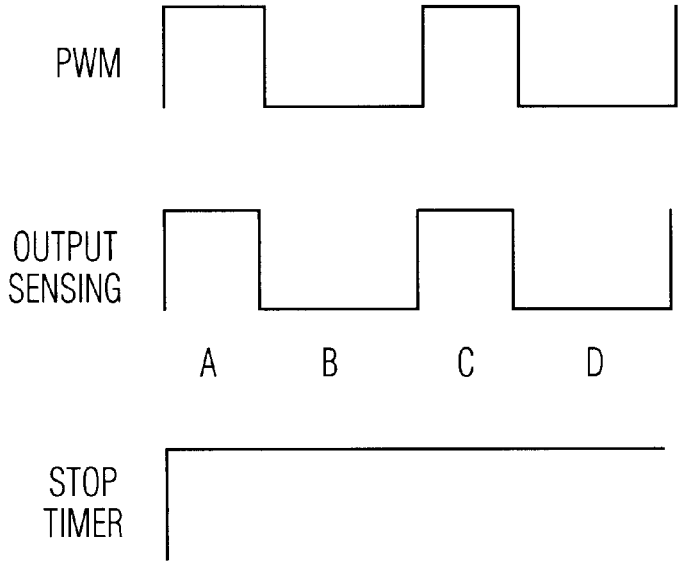
FIG. 2B (PRIOR ART)
FIG. 2B illustrates a timing diagram during activation of a one shot timer shown in FIG. 2A.
Figure 2C:
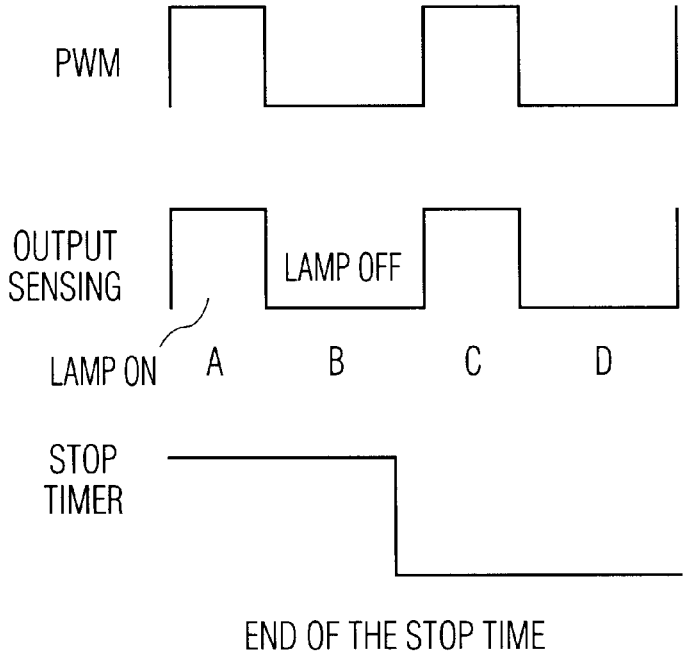
FIG. 2C (PRIOR ART)
FIG. 2C illustrates a timing diagram during deactivation of the one shot timer shown in FIG. 2A.
Figure 3:
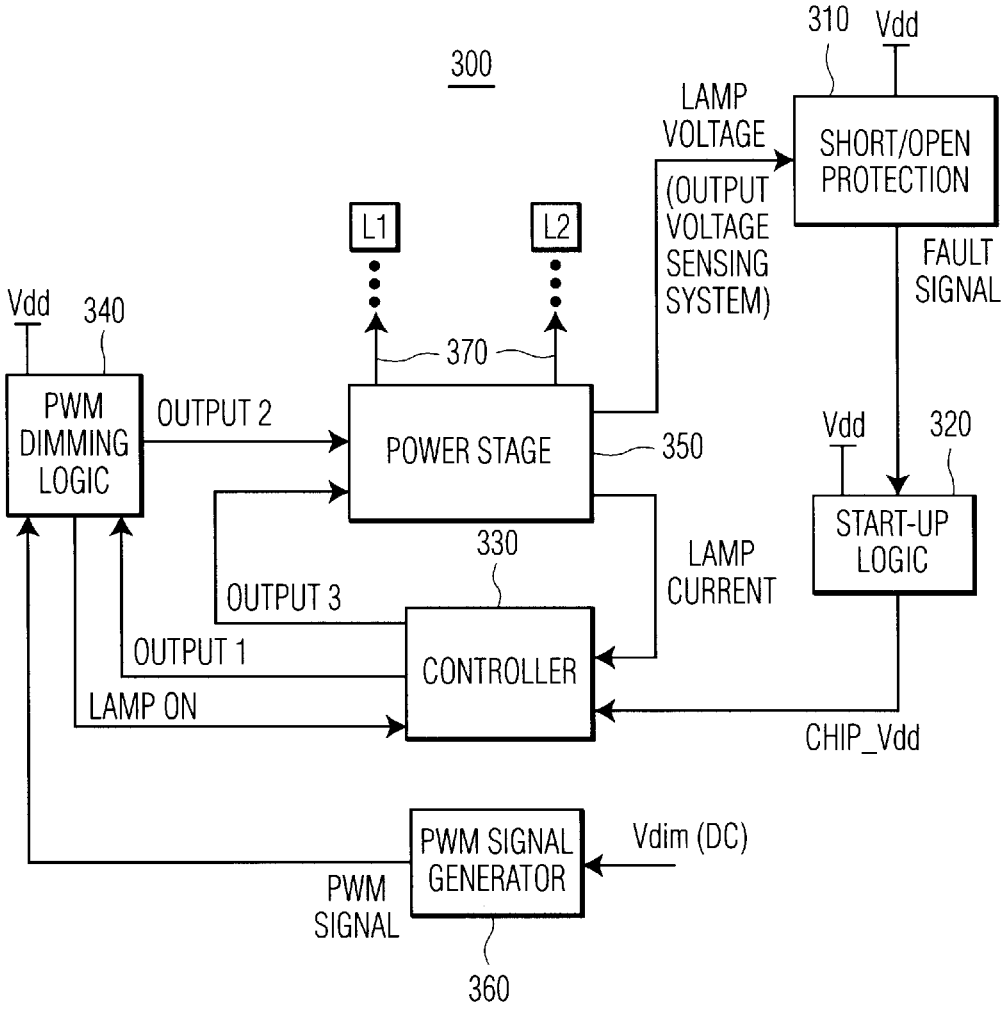
FIG. 3 is a block diagram of LCD backlight inverter circuitry for implementing an overvoltage protection system in accordance with the present disclosure.

With reference to FIG. 3 there is shown a block diagram of an LCD backlight inverter designated generally by reference numeral 300 for implementing the overvoltage protection system and method in accordance with an embodiment of the present disclosure. It is contemplated that the LCD backlight inverter 300 is similar in many aspects to the prior art backlight inverter which is schematically illustrated by FIG. 1 but has additional circuitry added thereto to implement the overvoltage protection system of the present disclosure. It is further contemplated that the backlight inverter 300 can be designed to control more than two lamps and/or other devices.

The LCD backlight inverter 300 controls lamps L1, L2. The backlight inverter 300 includes short/open protection circuitry 310, start-up logic circuitry 320, a controller 330, pulse width modulation (PWM) dimming logic circuitry 340, a power stage module 350 and a PWM signal generator 360 for generating a PWM signal. Two lamps L1, L2, i.e., the load, are connected to the power stage module 350. At least some of these components contain the inventive components and concepts described below, but otherwise are similar to and/or function in a similar manner to components in FIG. 1. For example, as in the various embodiments of the invention described below, the short/open protection circuitry 310 may contain the open protection circuitry of the present invention, but otherwise is similar to IC U7 and associated circuitry, the start-up logic circuitry 320 is similar to IC U8 and associated circuitry, the controller 330 is similar to IC U2 and associated circuitry, the PWM dimming logic circuitry 340 may contain additional circuitry of the present invention, but otherwise is similar to IC U3 and associated circuitry, the PWM signal generator 360 is similar to the PWM signal generator GEN, and the power stage module 350 is similar to power stage module PSM. It is contemplated, however, that the inventive components of the invention may be located in components of the LCD backlight inverter 300 other than the ones of the exemplary embodiments.

It is further contemplated that the short/open protection circuitry 310, the start-up logic circuitry 320, the controller 330, and the pulse width modulation (PWM) dimming logic circuitry 340 are provided as integrated circuit chips or packages.

In operation, the PWM signal generator 360 of the LCD backlight inverter 300 receives a DC dimming voltage signal Vdim. The DC voltage signal Vdim drives the PWM signal generator 360 to generate the PWM signal. Preferably, the PWM signal is a square wave signal which is inputted to the PWM dimming logic circuitry 340, along with another signal OUTPUT1 outputted from the controller 330, for driving circuitry therein to effect dimming of the backlight inverter 300.

Dimming of the backlight inverter 300 is effected by an oscillating signal OUTPUT2 outputted by the PWM dimming logic circuitry 340 and oscillating signal OUTPUT3 outputted by the controller 330. Signals OUTPUT2 and OUTPUT3 are input to the power stage module 350 to drive half-bridge switches of the power stage module 350 for driving the lamps L1, L2 via, for example, transformers.

The power stage module 350 outputs a lamp current signal to the controller 330 and a lamp voltage or output voltage sensing signal to the short/open protection circuitry 310. Another voltage signal or a protection trigger threshold voltage signal may be inputted to, or generated within, the short/open protection circuitry 310.

The output voltage sensing signal represents the ballast output voltage to the lamps L1, L2 and can be obtained from an output transformer sensing winding or a capacitor divider that interfaces with the ballast outputs 370 as known in the art. The protection trigger threshold voltage signal represents a voltage level at a predetermined amount above the nominal loaded lamp voltage and below the unloaded overvoltage. The output voltage sensing signal is preferably scaled by a ratio factor to represent the output voltage and the protection trigger threshold voltage is scaled by the same factor.

The short/open protection circuitry 310 uses these two signals to detect if an open circuit or overvoltage condition is present across the ballast outputs 370. If an overvoltage condition is present, after a predetermined one shot time interval, the circuitry 310 sets a latch (as described below with respect to FIGS. 4A–6) and transmits a fault signal to the start-up logic circuitry 320. The start-up logic circuitry 320 stops supplying a chip $V_{dd}$ signal to the controller 330 to stop the operation of the controller 330, and hence terminates oscillation of output signals OUTPUT1 (thereby terminating oscillation of output signal OUTPUT2 of the PWM dimming logic circuitry 340) and OUTPUT3. Thus, the power to the lamps L1, L2 by the power stage module 350 is interrupted, causing the output voltage across the ballast outputs 370 to be reduced.

If the short/open protection circuitry 310 fails to detect an overvoltage condition across the ballast outputs 370 after the predetermined one shot time interval, it stops supplying the fault signal and the start-up logic circuitry 320 resumes supplying the chip _Vdd signal and PWM dimming of the backlight inverter 300 resumes.

The present disclosure describes two overvoltage protection system embodiments for implementing within the backlight inverter 300 to effect overvoltage protection. A first embodiment is described with reference to FIGS. 4A–4C and a second embodiment is described with reference to FIGS. 5A–6B.

Figure 4A:
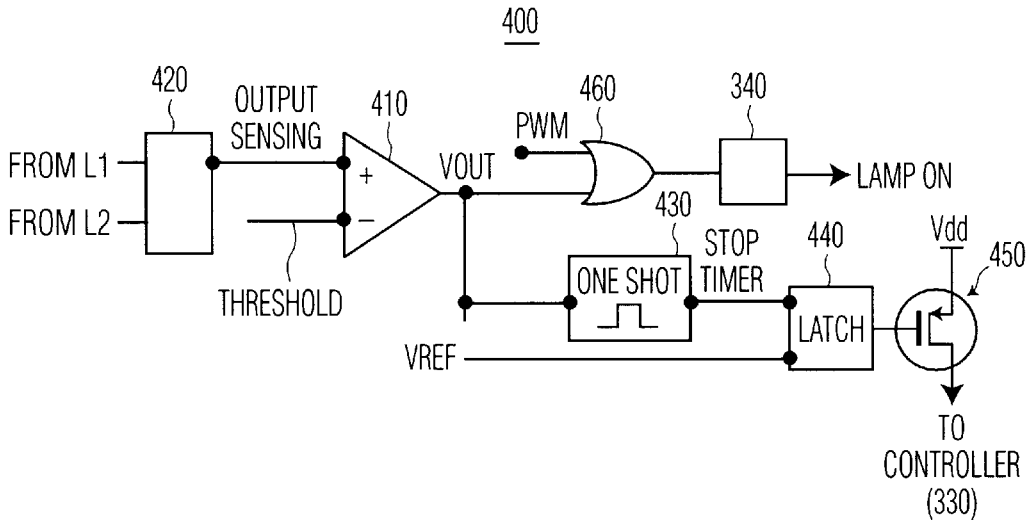
FIG. 4A is a schematic diagram illustrating a first embodiment of the overvoltage protection system effectuating overvoltage protection in accordance with the present disclosure.

The embodiment of FIG. 4A is designated generally by reference numeral 400 and it includes a comparator 410 having two inputs for receiving the output voltage sensing and protection trigger threshold voltage signals. The output voltage sensing signal (labeled "OutputSensing" in FIG. 4A) is received via a rectifier circuit 420 from the power stage module 350, in order for the output voltage sensing signal to be converted to a DC signal. The protection trigger threshold voltage signal is labeled "Threshold" in FIG. 4A. An output (Vout) of the comparator 410 is received by a one shot timer 430.

Another reference voltage signal Vref is received by a latch 440. The latch 440 also receives an output of the one shot timer 430 (labeled "StopTimer" in FIG. 4A) and outputs an output signal to a switch or the gate of a transistor 450. The output signal of the latch 440 switches the transistor 450 off or on according to whether the output voltage sensing signal is greater than or less than the protection trigger threshold voltage signal after the predetermined time interval.

The embodiment 400 further includes an OR gate 460 having two inputs. The OR gate 460 may be located outside or within PWM dimming logic circuitry 340. One input of the OR gate 460 receives the PWM signal from the PWM signal generator 360 and the other input of the OR gate 460 receives the output voltage Vout from the comparator 410. Based on the logic levels of the two signals, the OR gate 460 outputs a logic high or a logic low signal. The PWM dimming logic circuitry 340 uses this signal to generate a logic high or a logic low LampOn signal which is transmitted to the controller 330 to control oscillation of the OUTPUT3 signal sent to the power stage module 350 (see FIG. 3). The LampOn signal also controls oscillation of the OUTPUT2 signal sent to the power stage module 350. It is noted that the LampOn signal may be transmitted indirectly to the controller 330 and not directly as shown by FIG. 3.

For example, if the output voltage Vout has a logic high level, then the LampOn signal also has a logic high level which prevents PWM modulation of the OUTPUT2 signal.

Accordingly, PWM dimming is blocked at the power stage module 350 and the power stage module 350 operates at a full light output mode. As long as the output voltage sensing signal "OutputSensing") is greater than the protection trigger threshold voltage "Threshold"), the Vout output of the comparator 410 results in the OR gate 460 generating the LampOn signal, thus blocking the PWM oscillation. If the LampOn signal has a logic low level, the OUTPUT2 signal continues to be modulated by the PWM signal and the power stage module 350 operates in the PWM dimming mode.

Figure 4B:
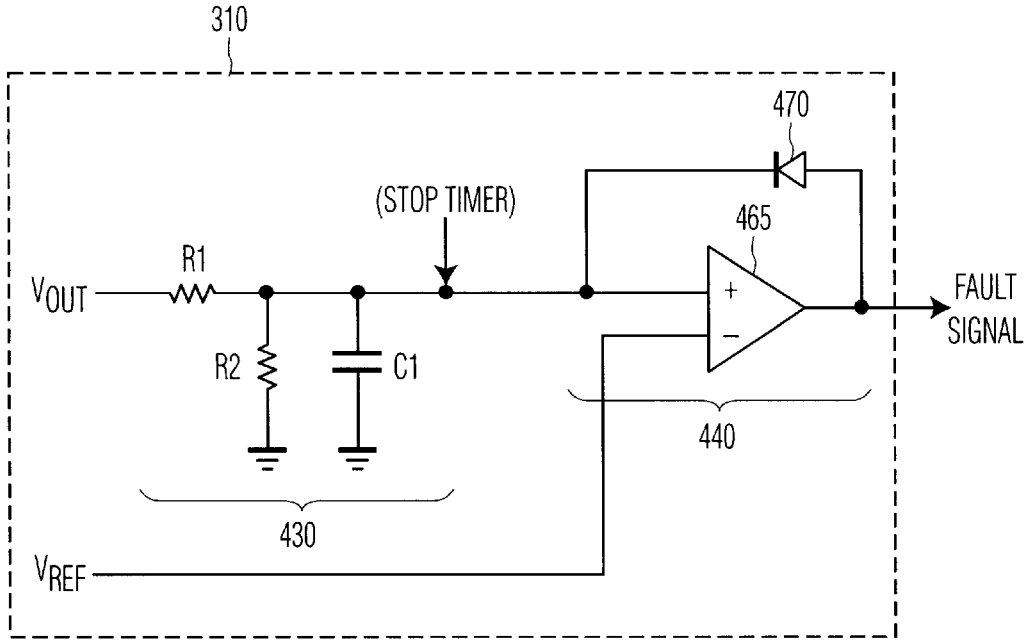
FIG. 4B is a schematic diagram of a one shot timer and a lach incorporated within the first and second embodiments of the present disclosure.

The one shot timer 430 is shown by FIG. 4B and it includes an RC circuit having a capacitor C1 and resistors R1 and R2 as known in the art. The length of the one shot time interval is determined according to the capacitance value of the capacitor C1 and the resistance value of the resistors R1 and R2. Resistor R2 is provided in parallel to the capacitor C1. The input voltage Vout is the output voltage from the comparator 410. Thus, where there is an overvoltage condition and Vout is a constant high signal, at the end of the one shot time interval, the input voltage Vout is also output by the one shot timer 430 as the "StopTimer" output that is input to latch 440. The latch 440 is also shown by FIG. 4B and it includes a comparator 465 and a diode 470 connected in parallel forming a positive feedback loop as known in the art. The latch 440 has two inputs: an output from the one shot timer 430 and the reference voltage signal Vref for comparing with the output voltage Vout.

In particular, the embodiment of FIG. 4A, in conjunction with FIG. 4B, if the overvoltage condition still exists at the end of the predetermined stop time interval, e.g., for approximately 10 msec to one second, as timed by the one shot timer 430, the overvoltage voltage output Vout is input as the StopTimer input to the comparator 465, the latch 440 is set and transmission of the fault signal is generated. The fault signal is transmitted to the start-up logic circuitry 320.

As noted above, because of the operation of OR gate 460, PWM modulation will be blocked by generation of the LampOn signal while the output voltage sensing signal exceeds the protection trigger threshold voltage signal. Once the fault signal is generated, the transmission of the chip_ Vdd signal to the controller 330 is shut off. Hence, signals OUTPUT2 and OUTPUT3 stop oscillating and the power stage 350 is shut off. Thereby, the output voltage across the ballast outputs is reduced. Accordingly, overvoltage protection is provided.

It is contemplated that the overvoltage protection system 400 is designed to share the latch and associated circuitry of a short circuit protection system (or overcurrent protection system) within the short/open protection circuitry 310 of FIG. 3 to reduce the number of system components. By sharing components between the two protection systems, the total cost of the overvoltage protection system 400 is reduced.

Figure 4C:
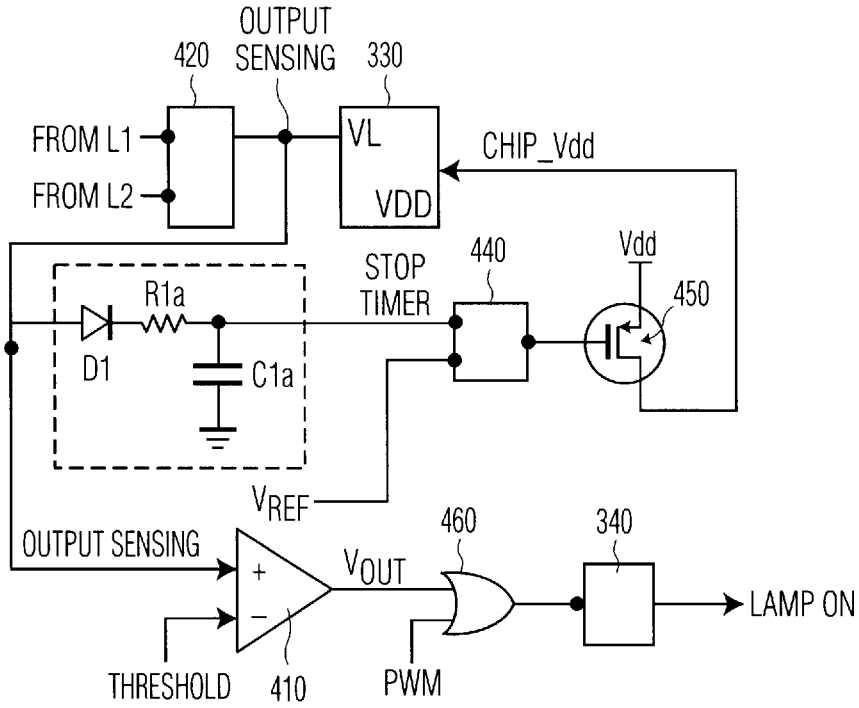
FIG. 4C is a schematic diagram illustrating a variation of the first embodiment of the overvoltage protection system effectuating overvoltage protection in accordance with the present disclosure.

A variation of the first embodiment is shown by FIG. 4C where primarily the same components of FIG. 4A are used with different connections therebetween. The rectifier circuit 420 receives the two input signals from the lamps L1, L2 and outputs the output voltage sensing signal "OutputSensing") to the controller 330, a one-shot timer 430*a* having a diode D1, resistor R1*a*, and capcitor C1*a*, and the comparator 410. The one-shot timer 430*a* outputs the StopTimer signal to the latch 440 provided the overvoltage condition is sustained for the time interval of the one-shot timer 430*a*) which triggers overvoltage protection if the output voltage sensing signal exceeds the reference voltage signal Vref. The comparator 465 (see FIG. 4B) in the latch 440 is used for the comparison of the output voltage sensing signal and the reference voltage signal Vref, and for setting the latch. If overvoltage protection is triggered, a fault signal is transmitted to the transistor 450 within the startup logic circuitry 320. Once the fault signal is generated, it shuts off transmission of the chip $_{Vdd}$ signal to the controller 330. Hence, signals OUTPUT2 and OUTPUT3 stop oscillating and the power stage 350 is shut off. Thereby, the output voltage across the ballast outputs is reduced. Accordingly, overvoltage protection is provided.

Further, because of the operation of OR gate 460, PWM modulation is blocked by generation of the Lamp On signal while the output voltage sensing signal exceeds the protection trigger threshold voltage signal.

Overvoltage can still be detected and the latch 440 can be set even without the comparator 410 and the OR gate 460, in other words, without blocking the PWM modulation. However, in such a case, the timing constant will not just be determined by the one-shot timer 430*a*, it will also be determined by the PWM modulation cycle, because the capacitor C1*a* is not discharged during a low interval of the PWM cycle. Discharge of the capacitor C1*a* is prevented during the PWM low interval by diode D1.

The components of the first embodiment as shown by FIGS. 4A–4C are located within the short/open protection circuitry 3 10, except for the OR gate 460 which may be located within or outside the PWM dimming logic circuitry 340 and the transistor 450 which may be located within the start-up logic circuitry 320.

Figure 5A:
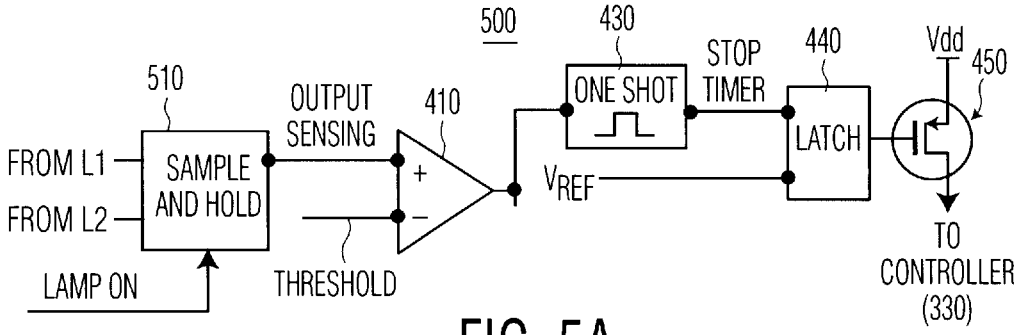
FIG. 5A is a schematic diagram illustrating a second embodiment of the overvoltage protection system effectuating overvoltage protection in accordance with the present disclosure.

In a first variation of a second embodiment according to the present disclosure, as shown by FIG. 5A and designated generally by reference numeral 500, overvoltage protection during PWM dimming of the LCD backlight inverter 300 is reliably detected, but PWM modulation which causes PWM dimming is not shut down upon detection of an overvoltage condition. In this case, PWM modulation of the OUTPUT2 signal is not blocked from reaching the power stage module 350 during the one shot timer interval.

Figure 5B:
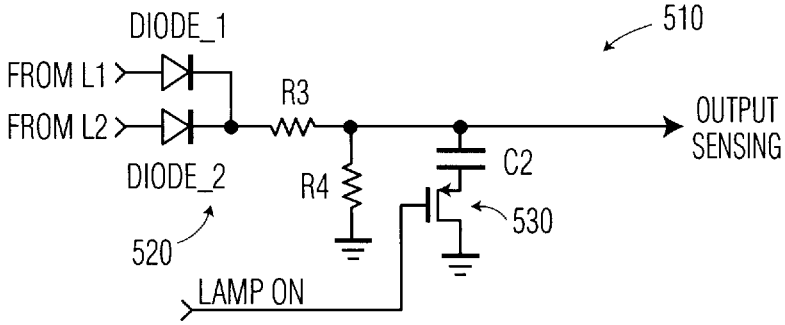
FIG. 5B is a schematic diagram illustrating a sample and hold circuit of FIG. 5A.

This is accomplished by connecting a sample and hold circuit 510 to the voltage sensing signals from the lamps L1, L2 and the comparator 410. The sample and hold circuit 510 receives the voltage sensing signals from the lamps L1, L2 and the LampOn signal. The sample and hold circuit 510 includes a rectifier circuit 520 therein to convert the voltage sensing signals to DC signals as shown by FIG. 5B. The rectifier circuit 520 includes two diodes DIODE_1 and DIODE_2, two resistors R3 and R4, and a capacitor C2.

The LampOn signal is provided to a gate of a sample and hold transistor 530 for allowing the sample and hold circuit 510 to receive and hold the output voltage sensing signal "OutputSensing") corresponding to the last lamp on period of the PWM cycle and not to discharge the signal during the subsequent lamp off period. This prevents the output voltage sensing signal from charging on and discharging off, i.e., from being synchronized with the output voltage. The output voltage sensing signal is then output by the sample and hold circuit 510 and input to the comparator 410 for comparison with the protection trigger threshold voltage signal "Threshold") using a similar circuit configuration as the first embodiment.

If the output voltage sensing signal (i.e., the voltage level as preserved in the sample and hold circuit 510) is greater than the protection trigger threshold voltage signal at the end of the timer period as output by the comparator 410 to the one shot timer 430, the latch 440 is set due to the output signal "StopTimer", which is then equal to the output voltage sensing signal) of the one shot timer 430 and the reference voltage signal Vref, and the fault signal is transmitted to the start-up logic circuitry 320 to stop supplying the supply voltage chip_Vdd to the controller 330 as described above. Accordingly, overvoltage protection is provided.

It is contemplated that the overvoltage protection system 500 shares the latch and associated circuitry of the short circuit protection system to reduce the number of components and the total cost.

Figure 6A:
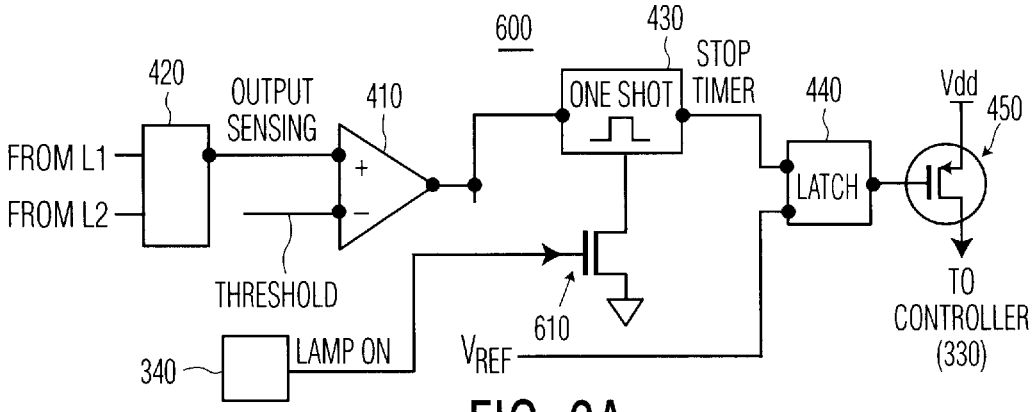
FIG. 6A is a schematic diagram illustrating a variation of the second embodiment of the overvoltage protection system effectuating overvoltage protection in accordance with the present disclosure.
Figure 6B:
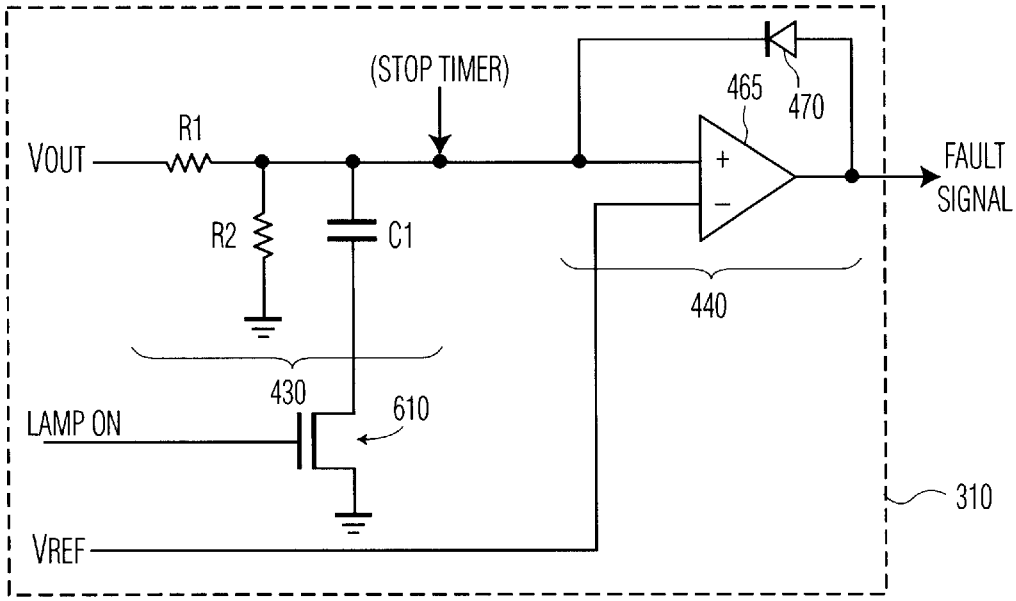
FIG. 6B is a schematic diagram of the one shot timer and the latch of FIG. 4B and a transistor connected to the one shot timer.

A second variation of the second embodiment, as shown by FIGS. 6A and 6B and designated generally by reference numeral 600, provides that the sample and hold circuit transistor 530 is not used for the output sensing voltage signal, but for the one shot timer 430. In this case, a series switch 610, preferably, either a BJT or MOS transistor, is connected to the capacitor C1 of the one shot timer 430 (see FIG. 6B). The switch 610 is controlled either from its base or gate by the LampOn signal outputted from the PWM dimming logic circuitry 340.

By using the series switch 610, the one shot time of the one shot timer 430 is accumulated during the on period of the PWM signal and the capacitor C1 is not discharged during the off period of the PWM signal. The one shot timer 430 will thus reach the end of the predetermined one shot time when the lamps L1, L2 are on. If there is an overvoltage condition at that time, the latch 440 is set, due to the output signal of the one shot timer 430 (which is then equal to overvoltage Vout) and the reference voltage signal Vref, and the fault signal is transmitted to the start-up logic circuitry 320 to stop supplying the supply voltage chip_Vdd to the controller 330 and hence, shut down the power stage module 350. Accordingly, overvoltage protection is provided.

The components of the second embodiment, including the first and second variations, are located within the short/open protection circuitry 310.

It will be understood that various modifications may be made to the embodiments disclosed herein and that the above description should not be construed as limiting, but merely as exemplifications of preferred embodiments. Those skilled in the art will envision other modifications within the scope and spirit of the claims appended hereto.

What is claimed is:

1. A system for providing power to a gaseous discharge lamp apparatus and for alternately switching the power on and off to effect dimming, said system including circuitry for protecting against an electrical fault condition comprising:

a. detection circuitry for detecting the occurrence of the electrical fault condition while the power is on;

b. timer circuitry for measuring a predetermined elapsed time period from the detection of the electrical fault condition;

c. interrupt circuitry for interrupting the provision of the power to the lamp apparatus if the electrical fault condition continues to be detected while the power is on substantially at the end of the predetermined elapsed time period.

2. A system as in claim 1 where the electrical fault condition comprises an overvoltage.

3. A system as in claim 1 comprising a ballast for powering a fluorescent lamp apparatus.

4. A system as in claim 1 comprising a ballast for powering an LCD backlight apparatus.

5. A system as in claim 1 where the detection circuitry comprises a comparator for comparing a signal representative of an output for connection to the lamp apparatus with a threshold voltage.

6. A system as in claim 5 where the threshold voltage represents an output voltage magnitude which is larger than a loaded voltage and smaller than an unloaded voltage.

7. A system for providing power to a gaseous discharge lamp apparatus and for alternately switching the power between an ON state and an OFF state to effect dimming, said system including circuitry for protecting against an electrical fault condition comprising:

a. detection circuitry for detecting the occurrence of the electrical fault condition while the power is in the ON state;

b. logic circuitry for maintaining the power in the ON state during detection of the electrical fault condition;

c. timer circuitry for measuring a predetermined elapsed time period from the detection of the electrical fault condition;

d. interrupt circuitry for interrupting the provision of the power to the lamp apparatus if the electrical fault condition continues to be detected substantially at the end of the time period.

8. A system as in claim 7 where the electrical fault condition comprises an overvoltage.

9. A system as in claim 7 comprising a ballast for powering a fluorescent lamp apparatus.

10. A system as in claim 7 comprising a ballast for powering an LCD backlight apparatus.

11. A system as in claim 7 where the detection circuitry comprises a comparator for comparing a signal representative of an output for connection to the lamp apparatus with a threshold voltage.

12. A system as in claim 11 where the threshold voltage represents an output voltage magnitude which is larger than a loaded voltage and smaller than an unloaded voltage.

13. A system for providing power to a gaseous discharge lamp apparatus and for alternately switching the power between an ON state and an OFF state to effect dimming, said system including circuitry for protecting against an electrical fault condition comprising:

a. detection circuitry for detecting the occurrence of the electrical fault condition while the power is in the ON state;

b. storage circuitry for, during each ON state when the electrical fault condition is detected, storing an indication of said detection;

c. timer circuitry for measuring a predetermined elapsed time period from the detection of the electrical fault condition;

d. interrupt circuitry for interrupting the provision of the power to the lamp apparatus if the indication of the electrical fault condition continues to be exist substantially at the end of the time period.

14. A system as in claim 13 where the storage circuitry comprises a sample and hold circuit.

15. A system as in claim 13 where the electrical fault condition comprises an overvoltage.

16. A system as in claim 13 comprising a ballast for powering a fluorescent lamp apparatus.

17. A system as in claim 13 comprising a ballast for powering an LCD backlight apparatus.

18. A system as in claim 13 where the detection circuitry comprises a comparator for comparing a signal representative of an output for connection to the lamp apparatus with a threshold voltage.

19. A system as in claim 18 where the threshold voltage represents an output voltage magnitude which is larger than a loaded voltage and smaller than an unloaded voltage.

20. A method of providing power to a gaseous discharge lamp apparatus, said method comprising:

a. alternately switching the power on and off to effect dimming;

b. detecting the occurrence of an electrical fault condition while the power is on;

c. measuring a predetermined elapsed time period from the detection of the electrical fault condition;

d. interrupting the provision of the power to the lamp apparatus if the electrical fault condition continues to be detected while the power is on substantially at the end of the predetermined elapsed time period.

21. A method as in claim 20 where the electrical fault condition comprises an overvoltage.

22. A method as in claim 20 for powering a fluorescent lamp apparatus.

23. A method as in claim 20 where the electrical fault condition is detected by comparing a signal representative of an output voltage with a threshold voltage.

24. A method as in claim 23 where the threshold voltage represents an output voltage magnitude which is larger than a loaded voltage and smaller than an unloaded voltage.

25. A method of providing power to a gaseous discharge lamp apparatus, said method comprising:

a. alternately switching the power between an ON state and an OFF state to effect dimming;

b. detecting the occurrence of an electrical fault condition while the power is in the ON state;

c. maintaining the power in the ON state during detection of the electrical fault condition;

d. measuring a predetermined elapsed time period from the detection of the electrical fault condition; and e. interrupting the provision of the power to the lamp apparatus if the electrical fault condition continues to be detected substantially at the end of the time period.

26. A method as in claim 25 where the electrical fault condition comprises an overvoltage.

27. A method as in claim 25 for powering a fluorescent lamp apparatus.

28. A method as in claim 25 where the electrical fault condition is detected by comparing a signal representative of an output voltage with a threshold voltage.

29. A method as in claim 28 where the threshold voltage represents an output voltage magnitude which is larger than a loaded voltage and smaller than an unloaded voltage.

30. A method of providing power to a gaseous discharge lamp apparatus, said method comprising:

a. alternately switching the power between an ON state and an OFF state to effect dimming;

b. detecting the occurrence of an electrical fault condition while the power is in the ON state;

c. during each ON state when the electrical fault condition is detected, storing an indication of said detection;

d. measuring a predetermined elapsed time period from the detection of the electrical fault condition;

e. interrupting the provision of the power to the lamp apparatus if the indication of the electrical fault condition continues to be exist substantially at the end of the time period.

31. A method as in claim 30 where the electrical fault condition comprises an overvoltage.

32. A method as in claim 30 for powering a fluorescent lamp apparatus.

33. A method as in claim 30 where the electrical fault condition is detected by comparing a signal representative of an output voltage with a threshold voltage.

34. A method as in claim 33 where the threshold voltage represents an output voltage magnitude which is larger than a loaded voltage and smaller than an unloaded voltage.

* * * * *